United States Patent [19]

Vizelyi

[11] 4,391,445

[45] Jul. 5, 1983

[54] LOGICAL SKILL TOY

[76] Inventor: Gábor Vizelyi, Pákozdi tér 3., Budapest 1148, Hungary

[21] Appl. No.: 235,528

[22] Filed: Feb. 18, 1981

[30] Foreign Application Priority Data

Apr. 3, 1980 [HU] Hungary ..... 802/80

[51] Int. Cl.[3] ..... A63F 9/08

[52] U.S. Cl. ..... 273/158; 273/159

[58] Field of Search ..... 273/158, 159

[56] References Cited

U.S. PATENT DOCUMENTS 2,324,566 7/1943 Davis ..... 273/158 X

*Primary Examiner*—Anton O. Oechsle

*Attorney, Agent, or Firm*—Gabriel P. Katona

[57] ABSTRACT

There is disclosed a logical toy in which a series of rigid hooks are fixed by legs about the perimeter of a disc. The legs are connected to the disc so that the annular closed part of each hook except the first in the series encloses the legs of the preceding adjacent hook to form a trap with said hook. A closed cord is arranged around the legs of one of the hooks. The object of the toy is to move the cord through the series of hooks.

4 Claims, 3 Drawing Figures

LOGICAL SKILL TOY

BACKGROUND

The invention relates to a logical skill-toy known under the name "diabolic wheel", which operator on the principle of the so-called "diabolic-lock".

As is known, the simple slip-knots (loop pairs) are generally made of a bent metal wire, which can be separated by a tricky move only, are called "diabolic locks". One of the preferable embodiments is represented by the "closed 8", i.e. the wire hooks when viewed from the top, as shown in FIG. 2, appear to be a series of closed loops, each adjacent pair resembling the shape of the numeral 8. Thus, since the series of hooks are closed, the phrase "closed 8" is used.

BRIEF DESCRIPTION OF THE INVENTION

The diabolic wheel according to the invention is similar to the hook of the diabolic lock having the shape of the numeral eight. Rigid wires are used in this case too, but with the difference that the legs of the diabolical lock are bent inwards, turned downwards and are fixed onto a bearing plate, whereby the legs become closed. The other element of the diabolic wheel is a closed cord (a loop), which presents difficult logical tasks for the player, as is described in detail below.

BRIEF DESCRIPTION OF THE DRAWINGS

The invention is described by means of the accompanying drawings, wherein.

DETAILED DESCRIPTION

Referring to the Figures, the legs 1' of the hooks 1 formed of a rigid wire were fixed onto the disc 2 to form a "play field" of the toy. The disc 2 is made of wood or of a synthetic material. The hooks which are connected to the legs and following the convex shape of the "play field" are arranged in such a manner that the legs of the following hook are always engaged into the previous one. Around the "play field" three or five or seven hooks may be so arranged. The part between the two legs forms a trap having the appearance of a closed system.

Figure 1:
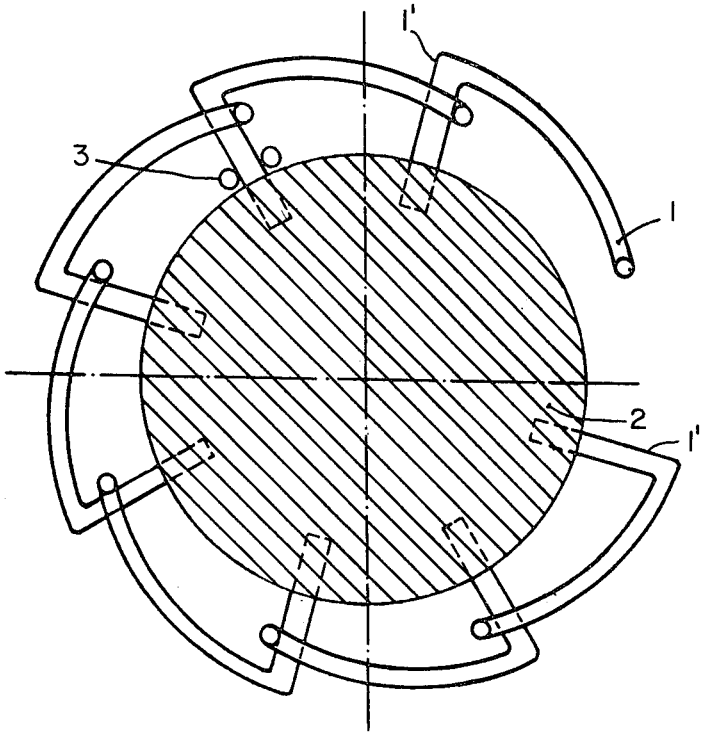
FIG. 1 is a sectional view of the diabolic wheel of this invention taken along line A—A of FIG. 2 comprising seven oval hooks.
Figure 2:
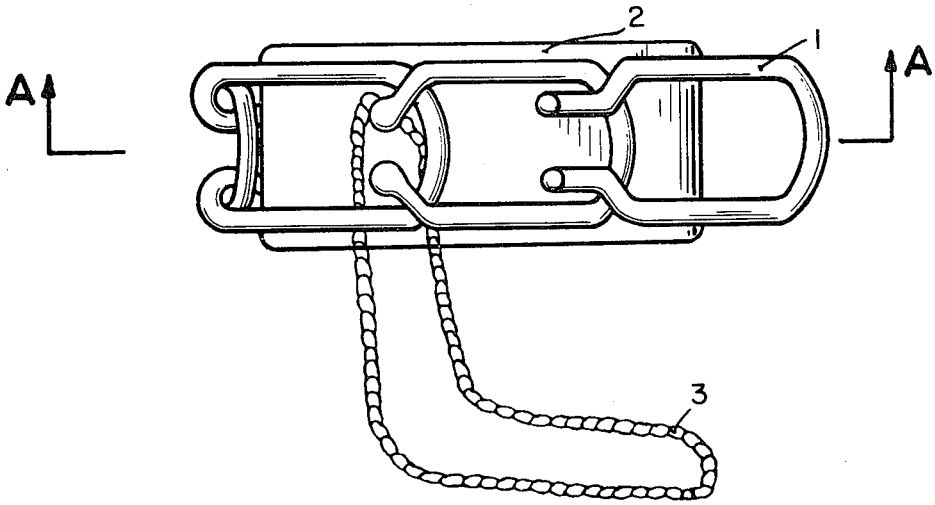
FIG. 2 is a top-view of the diabolic wheel of the invention.
Figure 3:
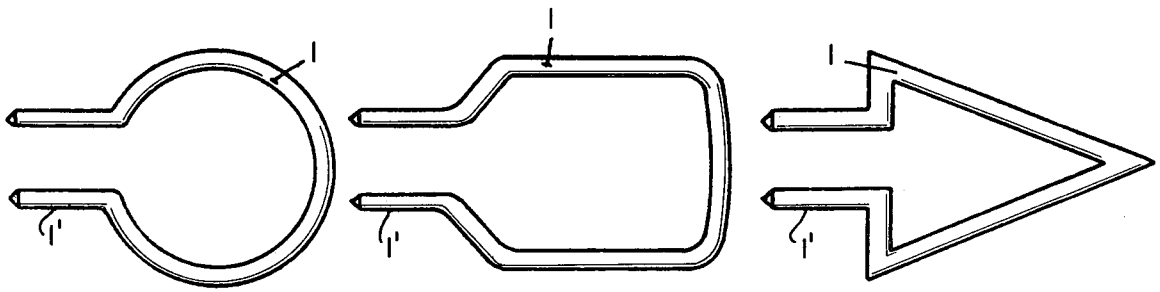
FIG. 3 is a top view showing three embodiments of the hooks forming the trap of the diabolical wheel of this invention.

As can be seen from FIG. 3, the loop of the hooks 1 can be of a variety of shapes, i.e. they can be generally circular, generally rectangular or generally triangular.

The essence of the play with the diabolic wheel is as follows: the closed cord-loop 3 is led in a tricky manner along the circular path from one trap to the other; the path may comprise 3 to 7 (or even more) traps. A characteristic feature lies in that at first sight leading the loop seems almost impossible, but after cogitation the player comes upon the solution and leads relatively easily the loop through the gap between the first legs and the second hook-head to the first trap. After having discovered said gap, it becomes obvious that the traps do not form a closed system and reaching the first trap seems to promise an easy progress; however, the progress to the next traps becomes increasingly complicated, since at every succeeding step the player is compelled to lead a part of the cord-loop 3 through the previously "conquered" traps. After having reached the third trap, even at a faultless guide of the loop, progress requires about 15–30 operational steps depending on the number of the traps already "conquered". Thus, as is apparent, with such a high number of operations, the number of possible erroneous steps is very high. However, every error may be corrected and the player is never confronted with an insoluble situation. The play always keeps its continuous character and interesting feature.

The diabolic wheel according to the invention can be produced in an aesthetic appearance, cheaply. It provides play suitable for developing logical ability and manual skill for any age-group.

What we claim:

1. A logical toy comprising a series of hooks with legs fixed about the perimeter of a disc, the legs of each of said hooks being fixed and connected to said disc so that the annular closed part of each hook except the first in the series encloses the legs of the preceding hook adjacent to it to thereby form a trap with said hook; and a closed cord arranged around the legs of one of said hooks.

2. The toy defined in claim 1, wherein said hooks are comprised of generally cylindrical metal wires placed in such a manner that a gap is formed between adjacent hooks, said gap being larger than the diameter of said cord to allow it to pass therethrough.

3. The toy defined in claims 1 or 2 wherein there are an odd number of hooks.

4. The toy defined in claim 3, wherein the number of hooks is 3, 5, or 7.

* * * * *